US009933240B2

(12) United States Patent
Cipolla et al.

(10) Patent No.: US 9,933,240 B2
(45) Date of Patent: Apr. 3, 2018

(54) UNDERWATER VEHICLE EQUIPPED WITH ELECTROCHEMICAL MEANS OF ELECTRICAL POWER GENERATION

(75) Inventors: Thierry Cipolla, Toulon (FR); Christophe Lebrun, La Garde-Freinet (FR)

(73) Assignee: DCNS, Paris (FR)

( * ) Notice: Subject to any disclaimer, the term of this patent is extended or adjusted under 35 U.S.C. 154(b) by 56 days.

(21) Appl. No.: 13/823,978

(22) PCT Filed: May 4, 2012

(86) PCT No.: PCT/EP2012/058295
§ 371 (c)(1),
(2), (4) Date: Nov. 4, 2013

(87) PCT Pub. No.: WO2012/150350
PCT Pub. Date: Nov. 8, 2012

(65) Prior Publication Data

US 2015/0149004 A1 May 28, 2015

(30) Foreign Application Priority Data

May 4, 2011 (FR) ..... 11 53813

(51) Int. Cl.
*F42B 19/36* (2006.01)
*F42B 19/00* (2006.01)
*F42B 19/12* (2006.01)

(52) U.S. Cl.
CPC ..... *F42B 19/36* (2013.01); *F42B 19/00* (2013.01); *F42B 19/12* (2013.01)

(58) Field of Classification Search
CPC ..... F42B 139/36; F42B 19/00; F42B 35/00; F42B 35/02; F42B 30/006; F42B 22/00;
(Continued)

(56) References Cited

U.S. PATENT DOCUMENTS 3,100,291 A * 8/1963 Abbott ..... 367/152
4,755,735 A * 7/1988 Inakagata ..... H02J 7/0091 320/150

(Continued)

FOREIGN PATENT DOCUMENTS

CN 101958562 A * 1/2011
EP 0224986 A2 6/1987
FR 2514319 4/1983

OTHER PUBLICATIONS

International Search Report for International Application No. PCT/EP2012/058295, dated May 30, 2012.

(Continued)

*Primary Examiner* — Genna M Mott
(74) *Attorney, Agent, or Firm* — Knobbe, Martens, Olson & Bear, LLP

(57) ABSTRACT

The invention concerns an underwater vehicle equipped with electrochemical means of electrical power generation, characterized in that it comprises a data processing unit (2) with inputs connected to sensors (4) of a parameter selected from amongst temperature, pressure, and hydrogen concentration, of the water in the area of the vehicle, and of the electrochemical means of the vehicle, and with outputs connected to means (5) of transmitting signals to transmit signals authorizing (or not authorizing) an operator to approach the vehicle, depending on whether the sensed value of the parameter of the electrochemical means is in a predetermined range around the value of the parameter corresponding to water in the area of the underwater vehicle.

11 Claims, 2 Drawing Sheets

(58) Field of Classification Search
CPC ..... F42B 17/00; F42B 15/00; F42B 15/34; F42B 8/12; F42B 8/00; F42B 8/28; F42B 6/00; F16P 1/00; B63C 7/00; H01M 2250/20; B60L 2240/545; B60L 3/0023; B60L 3/00; B60L 3/0053; B60L 3/0046; B60L 11/1881; B60L 11/1851; B60W 10/28; B60W 10/26; B60W 10/24; B60H 1/00278
USPC ..... 701/21
See application file for complete search history.

(56) References Cited

U.S. PATENT DOCUMENTS

| | | | | |
|---|---|---|---|---|
| 5,250,904 | A * | 10/1993 | Salander et al. | 324/430 |
| 6,038,689 | A * | 3/2000 | Schmidt | G06F 11/0748 709/224 |
| 6,326,097 | B1 * | 12/2001 | Hockaday | 429/417 |
| 8,169,195 | B1 * | 5/2012 | Chait et al. | 320/152 |
| 2007/0029974 | A1 * | 2/2007 | Uchida | 320/132 |
| 2010/0302051 | A1 * | 12/2010 | Hermann et al. | 340/636.11 |

OTHER PUBLICATIONS

Hooton, "Torpedoes Challenged," *Armada International*, vol. 29(6), pp. 44-46, 48 (2005).

* cited by examiner

UNDERWATER VEHICLE EQUIPPED WITH ELECTROCHEMICAL MEANS OF ELECTRICAL POWER GENERATION

CROSS-REFERENCE TO RELATED APPLICATIONS

This application is the U.S. National Phase under 35 U.S.C. § 371 of International Application PCT/EP2012/058295, filed May 4, 2012, which was published in a non-English language, which claims priority to FR 11 53813, filed May 4, 2011.

FIELD OF THE INVENTION

Background of the Invention

This invention concerns an underwater vehicle equipped with electrochemical means of electrical power generation.

Such a vehicle may consist, e.g., of an underwater weapon such as a torpedo.

In fact, it is known that this type of vehicle is equipped with electrochemical means of electrical power generation supplying its various components with electrical power.

In the context of development, evaluation, or deployment of such weapons, "training" torpedoes are used.

These torpedoes, e.g., lack weapons loads, which may be replaced by other means, such as means of data acquisition generally commonly known as "training units".

These "training" torpedoes are mostly intended to be recovered after firing.

In the prior art, various means to facilitate the recovery of such torpedoes have been proposed.

Thus, for example, means of locating them, or inflatable devices to facilitate their retrieval have already been proposed.

However, the issue of safety, in particular operator safety, arises in this recovery phase.

SUMMARY OF THE INVENTION

The objective of this invention is thus to solve these problems.

To this end, the invention concerns an underwater vehicle equipped with electrochemical means of electrical power generation, characterised in that it comprises a data processing unit with inputs connected to sensors of a parameter selected from amongst temperature, pressure, and hydrogen concentration, of the water in the area of the vehicle, and of the electrochemical means of the vehicle, and with outputs connected to means of transmitting signals to transmit signals authorising (or not authorising) an operator to approach the vehicle, depending on whether the sensed value of the parameter of the electrochemical means is in a predetermined range around the value of the parameter corresponding to water in the area of the underwater vehicle.

According to other embodiments, the underwater vehicle comprises one or more of the following characteristics, taken alone or in all combinations technically possible:

the data processing unit is connected to an electrical power supply independent of the rest of the underwater vehicle;

the power supply comprises means of storing energy;

the means of storing energy include a battery;

the means of storing energy include a fuel cell;

the means of transmitting signals authorising (or not authorising) approaching the vehicle comprise means of transmitting audio and/or visual and/or radioelectric signals;

the means of signal transmission comprise at least one electroacoustic transducer;

the data processing unit comprises means of testing for proper functioning to initiate the transmission of malfunction signals in the event of malfunction of the unit; and the electrochemical means include an input and an output, and the temperature sensors include temperature sensors at the input and output of these electrochemical means.

BRIEF DESCRIPTION OF THE DRAWINGS

The invention will be better understood based on the following description, provided by way of example only, referring to the attached drawings, in which.

DETAILED DESCRIPTION OF THE PREFERRED EMBODIMENTS

Figure 1:
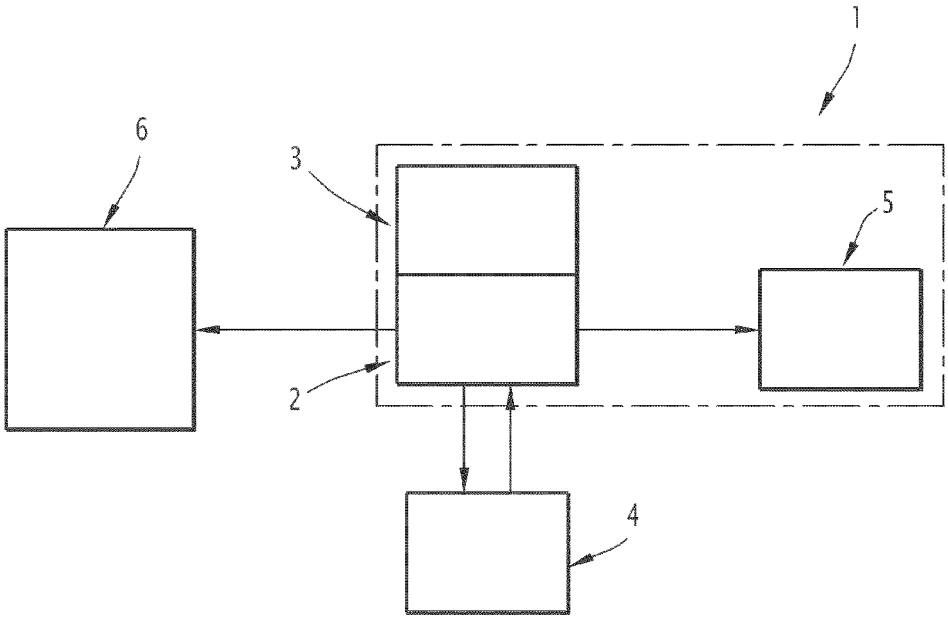
FIG. 1 shows a synoptic schematic of the structure of an approach authorisation device integrated into an underwater device according to the invention.

In fact, FIG. 1 shows a synoptic schematic of the structure of an approach authorisation device integrated into an underwater device according to the invention equipped with electrochemical means of electrical power generation.

As noted above, such an underwater vehicle may consist of a training torpedo intended to be recovered after firing.

Generally, it is known that these vehicles, in particular torpedoes of this kind, are equipped with electrochemical means of electrical power generation, e.g., based on fuel cells, intended to supply electrical power to the rest of the vehicle, in particular means of electrical motorisation of the vehicle, etc.

The electrical power used, in particular for "heavy" torpedoes, is extremely high, and the nature and operation of these electrochemical means of electrical power generation translate into an extremely substantial release of heat, such that this part of the torpedo may reach very high temperatures, which may constitute a danger for operators, in particular divers charged with recovering them.

To solve these problems, an approach authorisation device is integrated into the underwater vehicle.

This device comprises a data processing unit with inputs connected to sensors of a parameter selected from amongst temperature, pressure, and hydrogen concentration, of the water in the area of the vehicle, and of the electrochemical means of the vehicle, and with outputs connected to means of transmitting signals to transmit signals authorising (or not authorising) an operator to approach the vehicle, depending on whether the sensed value of the parameter of the electrochemical means is in a predetermined range around the value of the parameter corresponding to water in the area of the underwater vehicle.

FIG. 1 shows a synoptic schematic of an exemplary embodiment of such an approach authorisation device.

In this exemplary embodiment, the sensors are temperature sensors. It should be noted that pressure and/or hydrogen concentration sensors may also be considered.

This device is referred to by the general reference 1 on this drawing, and includes a data processing unit designated by general reference 2.

This consists, e.g., of any suitable computer or microcontroller or part of a computer already aboard the vehicle.

This device includes an electrical power supply independent of the rest of the underwater vehicle, which are dedicated to this approach authorisation device and include, e.g., means of power storage, such as a battery or a fuel cell or others, designated with general reference 3.

The data processing unit is connected at its input to sensors for the water temperature in the area of the vehicle and electrochemical means of the vehicle, designated with general reference 4 on FIG. 1.

The data processing unit is connected at its output to means of transmission of signals (not) authorising approaching the vehicle by an operator, illustrated by the general reference 5, in order to transmit signals (not) authorising an operator to approach the engine depending on whether the temperature of the electrochemical means is within a predetermined temperature range around the water temperature in the area of the underwater vehicle.

Various embodiments of these means of transmission may be considered, consisting, e.g., of audio and/or video and/or radioelectric or other signal transmission means.

Thus, for example, at least one electroacoustic transducer may be considered to transmit audio signals perceptible by an operator.

Lights may also be considered.

Depending on the information to be transmitted to the operator, the data processing unit and the means of transmission are adapted to transmit signals of different kinds, e.g., continuous/non-continuous/controlled repetition frequency signals, etc.

It should also be noted that the data processing unit may be equipped with means of testing proper operation upon its launch in order to transmit malfunction signals in the event of malfunction of the approach authorisation device, and warn operators so that they may take the necessary approach precautions.

Lastly, this unit may be connected to other elements of the vehicle, as designated with general reference 6 on FIG. 1.

Figure 2:
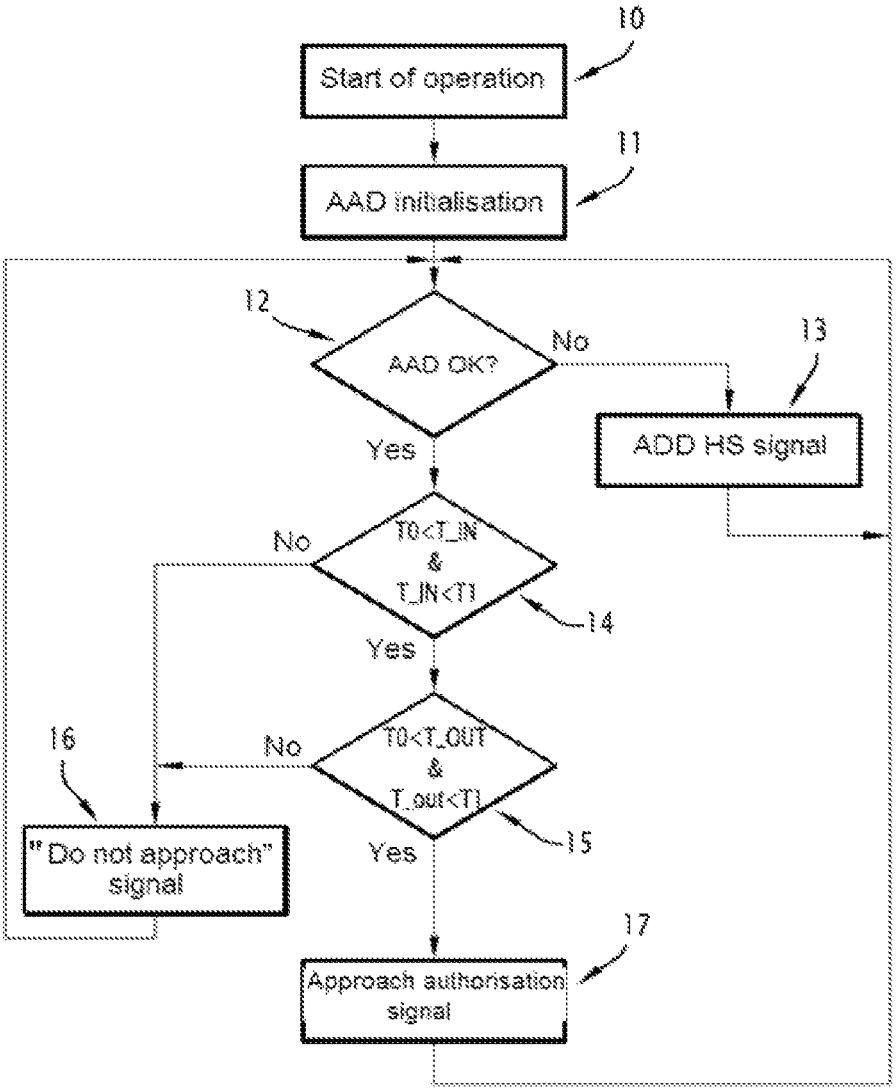
FIG. 2 shows the operation of that device.

FIG. 2 shows an example of the operation of this device.

The start of the operation of the approach device is designated by step 10 on this figure.

In 11, a step of initialisation of the operation of the approach authorisation device (AAD) is shown.

This initialisation step is followed by step 12, operation testing, in which testing means verify whether the approach authorisation device is operational.

If this is not the case, in step 13, the data processing unit is suited to initiate the transmission of signals indicating that the approach authorisation device is out of service.

On the other hand, if the approach authorisation device is operational in step 12, the data processing unit compares the temperature of the electrochemical means with the temperature of the water in the area of the vehicle in order to transmit signals (not) authorising the operator to approach the engine depending on whether the temperature of the electrochemical means is within a predetermined temperature range around the water temperature.

In the example shown in FIG. 2, two comparisons are carried out in steps 14 and 15.

In FIG. 2, T0 and T1 indicate the limits of the predetermined temperature range around the water temperature Tmer, to which the predetermined thresholds X and Y are added and subtracted.

Thus, T0=Tmer−X, and T1=Tmer+Y.

T-out and T-in are respectively the output and input temperatures of the electrochemical means.

Of course, other embodiments may be considered, and the relationships described above may be transposed to other parameters, such as pressure and hydrogen concentration.

Thus, depending on the comparisons made in steps 14 and 15 of the example shown, it is determined whether or not the input and/or output temperatures of the electrochemical means are not within the predetermined temperature ranges, the data processing unit is adapted to issue, in 16, signals prohibiting operators approaching the vehicle.

In fact, in this situation, operators approaching the engine may be dangerous, as the temperature of the electrochemical means may constitute a danger for the operators.

On the other hand, if the temperatures are within the predetermined ranges, the data processing unit is adapted to transmit, in 17, approach authorisation signals, indicating to operators that approaching the vehicle does not present any specific risk at this level.

Of course, other embodiments are also possible.

Such a structure thus has a certain number of benefits to the extent that it ensures safe recovery, in particular of this type of vehicle, by indicating to operators that operations can be carried out with risk, or, otherwise, that they should wait before recovering the vehicle.

What is claimed is:

1. An underwater vehicle configured to be recovered after firing, comprising an approach authorisation device, said device being equipped with an electrochemical power generator comprising a power input and a power output, said device further comprising a data processor having a data input connected to sensors of a parameter selected from the group consisting of temperature, pressure, and hydrogen concentration, the sensors configured to sense the parameter in both the water in the area of the vehicle and the water at the power input and the power output of the electrochemical power generator, and said data processor having a data output connected to a signal transmitter configured to transmit signals authorizing or not authorizing an operator to approach the vehicle, depending on whether the sensed value of the parameter at the power input and the power output of the electrochemical power generator is within a predetermined range around the sensed value of the parameter of the water in the area of the vehicle.

2. The underwater vehicle according to claim 1, wherein the data processor is connected to an electrical power supply independent of the rest of the underwater vehicle.

3. The underwater vehicle according to claim 2, wherein the power supply comprises an electrochemical power source.

4. The underwater vehicle according to claim 3, wherein the electrochemical power source comprises a battery.

5. The underwater vehicle according to claim 3, wherein the electrochemical power source comprises a fuel cell.

6. The underwater vehicle according to claim 1, wherein the signal transmitter configured to transmit signals authorizing or not authorizing approaching the vehicle comprises a transmitter of audio and/or visual and/or radioelectric signals.

7. The underwater vehicle according to claim 6, wherein the signal transmitter comprises at least one electroacoustic transducer.

8. The underwater vehicle according to claim 1, wherein the data processor comprises a function tester configured to initiate the transmission of malfunction signals in the event of malfunction of the data processor.

9. A method for recovering an underwater vehicle according to claim 1, comprising:

firing the underwater vehicle, navigating the underwater vehicle, locating the underwater vehicle, initializing the approach authorisation device, sensing, with the sensors, a parameter selected from the group consisting of temperature, pressure, and hydrogen concentration in both the water in the area of the vehicle and the water at the power input and the power output of the electrochemical power generator, transmitting, by the signal transmitter, of signals authorizing or not authorizing an operator to approach the vehicle, depending on whether the sensed value of the parameter at the power input and the power output of the electrochemical power generator is within a predetermined range around the sensed value of the parameter of the water in the area of the vehicle, and recovering the underwater vehicle.

10. The method according to claim 9, further comprising a testing step after the initializing to verify whether the approach authorisation device is operational.

11. The underwater vehicle according to claim 1, wherein the underwater vehicle is a training underwater vehicle.

* * * * *